United States Patent [19]

Yoshida

[11] 3,931,797

[45] Jan. 13, 1976

[54] AUTOMOBILE ENGINE CARBURETORS

[75] Inventor: Toshiro Yoshida, Toyoda, Japan

[73] Assignee: Toyota Jidosha Kogyo Kabushiki Kaisha, Japan

[22] Filed: Nov. 21, 1974

[21] Appl. No.: 525,812

[30] Foreign Application Priority Data

Dec. 29, 1973 Japan ..... 49-4170[U]

[52] U.S. Cl. ..... 123/119 F; 123/198 D; 261/39 E

[51] Int. Cl.[2] ..... F02M 1/12

[58] Field of Search ..... 123/119 E, 198 D; 261/39 E, 39 B

[56] References Cited

UNITED STATES PATENTS

| | | | |
|---|---|---|---|
| 2,031,709 | 2/1936 | Hunt | 261/39 E |
| 2,127,735 | 8/1938 | Hunt | 261/39 E |
| 2,263,027 | 11/1941 | Beard | 261/39 E |
| 3,058,727 | 10/1962 | Lucas | 261/39 B |
| 3,161,787 | 12/1964 | Van Saan | 123/119 F X |
| 3,179,098 | 4/1965 | High Zey et al. | 123/119 F |
| 3,190,274 | 6/1965 | Manning, Jr. et al. | 261/39 B X |
| 3,259,377 | 7/1966 | Braun et al. | 261/39 B |
| 3,291,461 | 12/1966 | Pope | 123/119 F X |
| 3,763,837 | 10/1973 | Orlando | 261/39 E X |

*Primary Examiner*—Charles J. Myhre
*Assistant Examiner*—Ira S. Lazarus
*Attorney, Agent, or Firm*—Stevens, Davis, Miller & Mosher

[57] ABSTRACT

An improved automobile engine carburetor in which a portion of the fresh air flowing into a carburetor main housing is bypassed through an auxiliary housing encasing a coiled bimetallic strip for controlling the position of a choke valve, so that the interior of the auxiliary housing may be maintained below a temperature at or above which the bimetallic strip may be heated to an unduly high temperature resulting in an earlier malfunction or failure. The improvement essentially comprises a first air passageway for letting fresh air into the auxiliary housing through an inlet provided upstream of a venturi throat in the main housing, a second air passageway for letting the air out of the auxiliary housing back into the main housing through an outlet provided downstream of the inlet of the first air passageway and a valve provided in the auxiliary housing to close one of the first and second air passageways to stop the flow of fresh air into the auxiliary housing when the temperature of the air in the auxiliary housing is below a predetermined level, while opening the first or second air passageway to allow it to resume the flow of fresh air through the auxiliary housing upon elevation of the auxiliary housing temperature to the predetermined level.

7 Claims, No Drawings

AUTOMOBILE ENGINE CARBURETORS

BACKGROUND OF THE INVENTION

This invention relates to improvements in an automobile engine carburetor, and particularly, to an improved electrically heated automatic choke for an automobile engine carburetor.

There is known an automobile engine carburetor including an electrically heated automatic choke essentially comprising a choke valve positioned in a carburetor air passage, an electric heater made, for example, of a nichrome wire, a coiled bimetallic strip operationally associated with the choke valve and heated by the electric heater to actuate the choke valve, and a housing in which the bimetallic strip and the electric heater are encased. The heater is turned on when the engine operation is started, and heats and deforms the bimetallic strip to thereby actuate the chock valve. The heater, however, continues to generate heat throughout the operation of the engine, and the temperature of the housing becomes very high. Accordingly, the bimetallic strip always remains exposed to a high temperature and fails in a short time.

SUMMARY OF THE INVENTION

It is an object of this invention to provide an improved automobile engine carburetor in which a coiled bimetallic strip can maintain its proper function for a long time without being heated to an unduly high temperature. According to this invention, there is provided an improved automobile engine carburetor essentially including a circuit for bypassing a portion of the air introduced into the carburetor, through a housing encasing a coiled bimetallic strip to prevent the strip from being heated to an unduly high temperature, and a valve adapted to open and close the bypassing circuit in response to variation in the temperature of the air in the housing to thereby maintain the temperature of the bimetallic strip at a suitable level.

DETAILED DESCRIPTION

Figure 1:
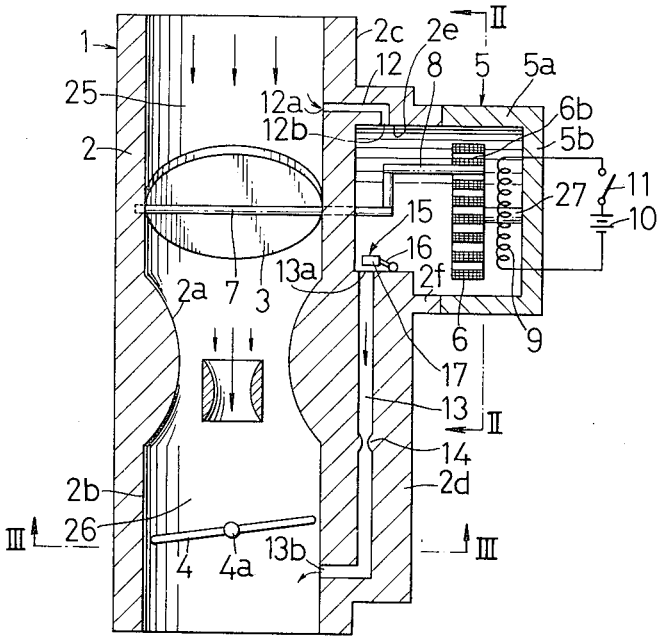
FIG. 1 is a vertical sectional view of the carburetor according to a preferred embodiment of this invention.

Referring to FIG. 1 of the drawings, an automobile engine carburetor 1 according to a preferred embodiment of this invention includes a generally cylindrical main housing 2 having an inner wall 2*b* and an outer wall 2*c*. The main housing 2 includes intermediate the upper and lower ends thereof a portion of a reduced inner diameter defining a venturi throat 2*a*. In the upper portion of the housing 2, the inner wall 2*b* defines an air stream passage 25 leading to the venturi throat 2*a*. A disc-shaped choke valve 3 is provided in the air stream passage 25 to cooperate with the inner wall 2*b* in opening or closing the air stream passage 25. The choke valve 3 is supported on a shaft 7 extending across the main housing 2 along a line parallel to the choke valve 3 but deviating from the center thereof. The shaft 7 is rotatably supported on the inner wall 2*b* at one end to permit rotation of the choke valve 3 about the shaft 7. The other end of the shaft 7 extends outwardly through the inner and outer walls 2*b* and 2*c* adjacent to a substantially diametrically opposite position of the choke valve 3 from the one end of the shaft 7. A disc-shaped throttle valve 4 is provided in a mixing chamber 26 downstream of the venturi throat 2*a* and supported on a rotatable shaft 4*a*. The throttle valve 4 is operationally associated with an accelerator pedal not shown. The air stream passage 25 communicates with an air cleaner not shown, and the mixing chamber 26 leads to an intake manifold also not shown. The choke valve 3 and the throttle valve 4 are operationally connected with each other by a fast idle device not shown.

Figure 2:
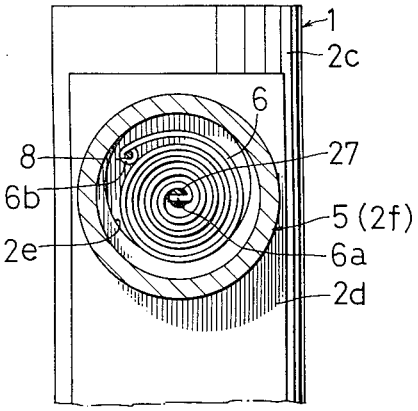
FIG. 2 is a sectional view taken along the line II—II of FIG. 1.
Figure 3:
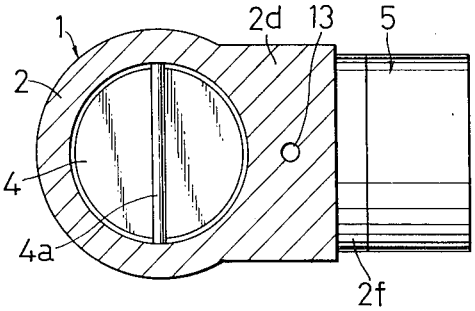
FIG. 3 is a sectional view taken along the line III—III of FIG. 1.

The main housing 2 is formed on its outer wall 2*c* with an elongate increased thickness portion 2*d* extending along a substantial portion of its length. The upper portion of the increased thickness portion 2*d* includes a circular recess 2*e* formed at right angles to the outer wall 2*c*. The other end of the shaft 7 extends into the recess 2*e*. A relatively short cylindrical projection 2*f* is integrally formed with the increased thickness portion 2*d* and encircles the circular recess 2*e* at the outer edge thereof. The cylindrical projection 2*f* has a somewhat larger inner diameter than the diameter of the recess 2*e* and while the uppermost inner edge of the cylindrical projection 2*f* coincides with the uppermost edge of the recess 2*e*, the lowermost inner edge of the projection 2*f* is spaced below the lowermost edge of the recess 2*e* as best shown in FIG. 2.

A cylindrical wall structure 5*a* is connected to the free end of the cylindrical projection 2*f* in a gas-tight manner and is closed by an end wall 5*b* to form a substantially closed, generally cylindrical auxiliary housing 5 with the circular recess 2*e* and the cylindrical projection 2*f* as shown in FIG. 1. The cylindrical wall 5*a* is perpendicular to the increased thickness portion 2*d* of the main housing 2 and is coaxial with the cylindrical projection 2*f*, while it is eccentric relative to the circular recess 2*e*. A shaft 27 extends horizontally from the center of the inner surface of the end wall 5*b* and terminates in a free end adjacent to the joint between the cylindrical projection 2*f* and the cylindrical wall 5*a*. The shaft 27 is coaxial with the cylindrical wall 5*a* and supports a coiled bimetallic strip 6 on the free end thereof as shown in FIG. 2. The coiled bimetallic strip 6 is fastened to the shaft 27 at its inner end 6*a*. The outer end 6*b* of the strip 6 is fastened to one end of a crank 8 and the other end of the crank 8 is integrally connected to the other end of the shaft 7 supporting the choke valve 3. Although no detailed description might be required for anyone of ordinary skill in the art with respect to the structure of the bimetallic strip 6, the strip 6 may be of such nature that when the temperature of the air in the auxiliary housing 5 remains reasonably low, the strip 6 will maintain the crank 8 in the position where the crank 8, through the shaft 7, maintains the choke valve 3 in its closed position to keep the air stream passage 25 closed, while with an increase in the housing temperature the strip 6 is deformed to rotate the crank 8 in a reverse direction to permit the choke valve 3 to open. An electric heater 9 is interposed between the end wall 5*b* of the housing 5 and the bimetallic strip 6 and may, for example, be made of a coiled nichrome wire. One end of the heater 9 is connected to a battery 10 and the other end thereof to an ignition switch 11 in an engine starting circuit, as schematically shown in FIG. 1, so that the heater 9 may be turned on when the operation of the engine not shown is started.

According to a specific feature of this invention, a first air passageway 12 is formed transversely through the inner and outer walls 2*b* and 2*c* in the upper portion of the main housing 2 and defines an air inlet for the auxiliary housing 5. The passageway 12 has an inlet 12*a* formed on the inner wall 2*b* of the main housing 2 in a position spaced above the choke valve 3. The passageway 12 extends into the uppermost end of the increased thickness portion 2*d* and turns downwardly to terminate in an outlet 12*b* which opens into the circular recess 2*e* at the uppermost edge thereof. The passageway 12 serves to bypass a portion of the air from the main housing 2 into the auxiliary housing 5, as indicated by an arrow in the drawings. While the passageway 12 is herein shown and described as provided upstream of the chike valve 3, it will readily be understood that it may equally be provided in any other convenient location. For example, the passageway 12 may be provided in a position between the choke valve 3 and the venturi throat 2*a* to produce as satisfactory a result as when it is positioned as shown and described.

A second air passageway 13 extends downwardly through the increased thickness portion 2*d* along a substantial portion of the length thereof. The second air passageway 13 is located in a substantially diametrically opposite position of the circular recess 2*e* from the first air passageway 12 and defines an air outlet from the auxiliary housing 5. The passageway 13 is parallel to the main housing 2 along the greater part of the length thereof and has at its upper end an inlet 13*a* which opens into the housing 5 at the lowermost edge of the recess 2*e*. The passageway 13 is bent at the lower end thereof and extends horizontally through the wall of the main housing 2 until it terminates in an outlet 13*b* which opens into the mixing chamber 26 in a position spaced below the throttle valve 4. Thus, the first and second air passageways 12 and 13 define an air bypassing circuit through the auxiliary housing 5. The air introduced into the auxiliary housing 5 through the first air passageway 12 returns into the main housing 2 through the second air passageway 13. The second air passageway 13 is reduced in diameter approximately in the middle of the vertically extending portion thereof to form a throat 14 to regulate the flow of the air through the passageway 13.

A valve 15 is provided adjacent to the inlet 13*a* of the second air passageway 13 to regulate the flow of air into the auxiliary housing 5. The valve 25 comprises a supporting member 16 of a bimetallic structure secured at one end to the lowermost edge of the circular recess 2*e*, and a valve member 17 secured to the other end of the supporting member 16. The bimetallic structure of the supporting member 16 is such that with an increase in the temperature of the air in the housing 5, the supporting member 16 is bent upwardly to move the valve member 17 away from the inlet 13*a* of the passageway 13, while it returns to its lower position to allow the valve member 17 to close the inlet 13*a* with a decrease in the temperature of the air in the housing 5.

For some time after the engine operation is started with the ignition switch 11 turned on, the force of the air acting upon the choke valve 3 to rotate it open is counterbalanced by the elastic force of the bimetallic strip 6 acting upon the crank 8, so that the choke valve 3 is maintained in its horizontal position and keeps the air stream passage 25 closed relative to the venturi throat 2*a*. The battery 10 supplies an electric current to the heater 9 and the heater 9 heats the interior of the housing 5, thereby heating the bimetallic strip 6. As the bimetallic strip 6 is heated to a higher temperature, the outer end 6*b* of the strip 6 is deflected outwardly to rotate the crank 8 in the direction which allows the choke valve 3 to open, whereby the air introduced into the carburetor 1 is allowed to flow past the choke valve 3 into the venturi throat 2*a*. The air flowing past the choke valve 3 creates a force to open the choke valve 3 to a further degree until the force of the air is offset by the elastic force of the bimetallic strip 6. Thus, the bimetallic strip 6 which is at a low temperature during the initial stage of the engine operation maintains the choke valve 3 in its closed position, whereby a low air pressure is maintained in the venturi throat 2*a*. Accordingly, a rich fuel-air mixture is obtained in the mixing chamber 26 and facilitates the engine operation during the initial stage thereof. After the engine is brought into steady operation, however, the bimetallic strip 6 is heated to a higher temperature and causes the choke valve 3 to gradually open, whereby a greater quantity of air is allowed to flow into the venturi throat 2*a* to produce a less rich fuel-air mixture which is sufficient to maintain the normal engine operation.

Attention is now directed to the salient features of the operation of the carburetor according to this invention. Insofar as the heater 9 continues to generate heat throughout the duration of the engine operation, there would be a continual increase in the temperature of the air in the auxiliary housing 5 if there were no provision for keeping the temperature from going up unduly high, and the natural consequence would be an earlier failure of the bimetallic strip 6. According to this invention, when the temperature of the air in the housing 5 is about to rise to a point which will be detrimental to the bimetallic strip 6, the bimetallic supporting member 16 of the valve 15 responds to an increased temperature and is deflected upwardly to move the valve member 17 away from the inlet 13*a*, whereby an air bypassing circuit is established by the first and second air passageways 12 and 13 to introduce an additional flow of air into the housing 5 to eventually cool the bimetallic strip 6. As long as the valve member 17 is in its raised position, the air bypassed through the first air passageway 12 into the housing 5 leaves the housing 5 through the second air passageway 13 and a fresh flow of air is admitted into the housing 5 continuously through the first air passageway 12, so that a continuous flow of cool air is maintained through the housing 5. The throat 14 formed in the second air passageway 13 prevents air circulation through the housing 5 from taking place at too fast a rate which may cause the valve 15 to close the inlet 13*a* too early while the bimetallic strip 6 is still at a temperature which may require additional cooling.

The temperature of the air in the housing 5 is thus lowered to a level below a predetermined temperature, which is a temperature in the range in which the bimetallic strip 6 maintains the choke valve 3 open to a sufficient degree to allow an adequate flow of air through the carburetor 1 throughout the engine operation. The bimetallic valve supporting member 16 is brought back to its lowered position and the valve member 17 rests over the inlet 13*a* to close the second air passageway 13, whereby air ceases to flow into the housing 5 through the first air passageway 12 and the temperature of the air in the housing 5 starts to increase again. The valve 15 opens or closes the second air passageway 13 in quick response to variation in the temperature of the air in the housing 5. This ensures that departure of the housing temperature from a predetermined level be maintained at a minimum throughout the engine operation, so that the temperature of the bimetallic strip 6 may be maintained within a predetermined range without rising to an unduly high level which would be detrimental to the satisfactory function of the strip 6 over a prolonged period of time.

Figure 4:
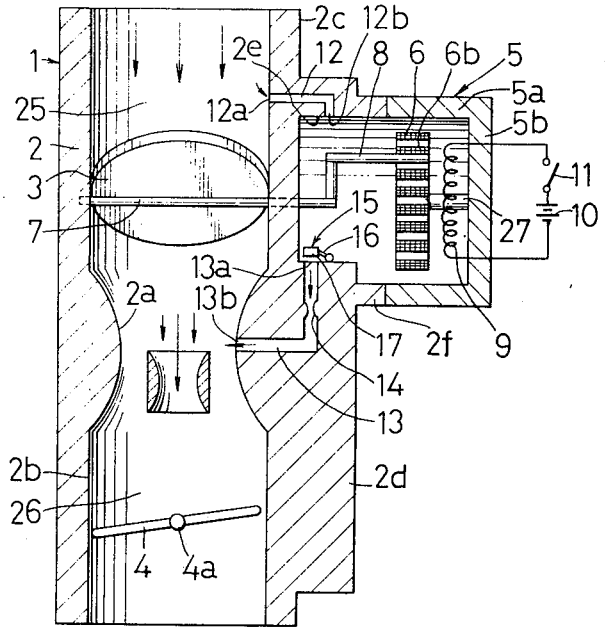
FIG. 4 is a view similar to FIG. 1 showing another embodiment of this invention.

FIG. 4 shows a modified form of the apparatus shown in FIG. 1. In the form shown in FIG. 4, the vertically extending portion of the second air passageway 13 is considerably shortened and the passageway 13 is bent horizontally in the mid-portion of the main housing 2 to position its outlet 13*b* at the venturi throat 2*a*. This is the only difference between the apparatus of FIG. 4 and that of FIG. 1, except that as the natural consequence of the shortened passageway 13 and merely because thereof, the throat 14 formed therein is in a higher position relative to the main housing 2 than its equivalent shown in FIG. 1. No further description would be necessary in respect of either the construction or operation of the apparatus shown in FIG. 4, in which like numerals are used to indicate like parts as they are used in FIG. 1.

Figure 5:
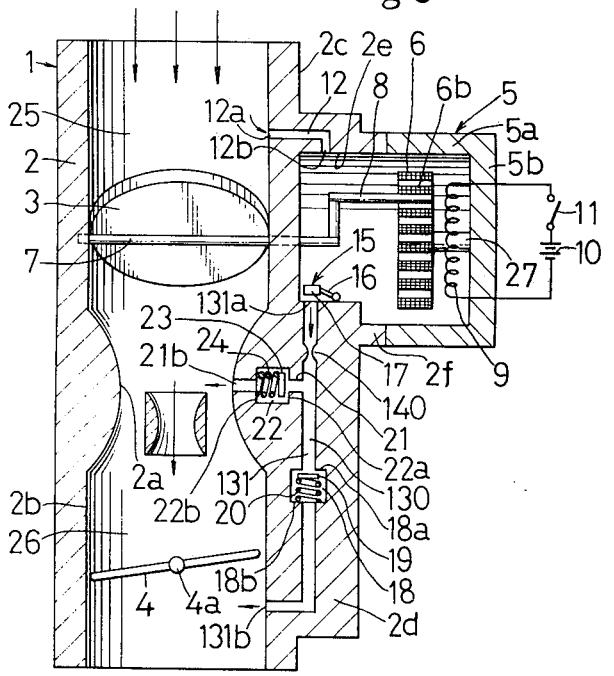
FIG. 5 is a view similar to FIGS. 1 and 4 showing a further embodiment of this invention.

The apparatus shown in FIG. 5 is a modified combination of the apparatus shown in FIGS. 1 and 4. The apparatus shown in FIG. 5 includes a second air passageway 130 which defines an air bypassing circuit through the auxiliary housing 5 with the first air passageway 12 which is identical in construction to that shown in FIGS. 1 or 4. The auxiliary housing 5 shown in FIG. 5 is identical in construction to that shown in FIG. 1 or 4. The second air passageway 130 is openable or closable by the valve 15 exactly in the same fashion as hereinabove described in connection with the apparatus of FIG. 1.

According to a specific feature of the apparatus shown in FIG. 5, the second air passageway 130 comprises a main line 131 and a branch line 21 which is perpendicular to the main line 131. The main line 131 has an inlet 131*a* in the same position as the inlet 13*a* of the second air passageway 13 shown in FIG. 1 and the inlet 131*a* may be opened or closed by the valve 15. The main line 131 extends vertically and is bent horizontally adjacent to the lower end of the increased thickness portion 2*d* to terminate in an outlet 131*b* which opens into the main housing 2 downstream of the throttle valve 4, as is the case with the second air passageway 13 shown in FIG. 1. The main line 131 is enlarged in diameter in its mid-portion to define a valve housing 18 which is coaxial with the main line 131. The enlarged diameter defines an upper shoulder 18*a* on the inlet side of the valve housing 18 and a lower shoulder 18*b* on the outlet side thereof. The valve housing 18 accommodates a coiled spring 20 in a coaxial relation therewith and the spring 20 is attached at one end to the lower shoulder 18*b* of the valve housing 18. The other end of the spring 20 carries a disc-shaped check valve member 19 which is coaxial with the main line 131. The valve member 19 is somewhat larger in diameter than the main line 131 and is adapted to rest on the upper shoulder 18*a* by the action of the spring 20 when the inlet 131*a* of the main line 131 remains closed by the valve 15, so that the valve member 19 may prevent any back flow of a portion of the fuel-air mixture from the mixing chamber 26 into the upper portion of the main line 131 above the valve housing 18. The main line 131 further includes a throat 140 which is identical in configuration, location and function to the throat 14 shown in FIG. 4.

The branch line 21 extends horizontally from the main line 131 in a position spaced above the valve housing 18, but below the throat 140. The branch line 21 is located in the same position relative to the main housing 2 as the horizontally extending portion of the second air passageway 13 shown in FIG. 4, and terminates in an outlet 21*b* which opens into the venturi throat 2*a*. The branch line 21 is also enlarged in diameter in its mid-portion to define a valve housing 22 which is coaxial with the branch line 21. The enlarged diameter defines an inlet side shoulder 22*a* on the right-hand side of the valve housing 22 in FIG. 5 and an outlet side shoulder 22*b* on the left-hand side thereof. The valve housing 22 accommodates a coiled spring 24 which is horizontally disposed in a coaxial relation with the valve housing 22. The spring 24 is attached at one end to the left-hand shoulder 22*b* of the valve housing 22. The other end of the spring 24 carries a disc-shaped chack valve member 23 which is vertically disposed in a coaxial relation with the branch line 21 and the spring 24. The valve member 23 is somewhat larger in diameter than the branch line 21 and is adapted to rest on the right-hand shoulder 22*a* of the valve housing 22 by the action of the spring 24 when the inlet 131*a* of the main line 131 remains closed by the valve 15, so that the valve member 23 may prevent any back flow through the branch line 21, i.e., the flow of a portion of air from the venturi throat 2*a* into the main line 131, then through the valve housing 18 into the fuel-air mixture in the mixing chamber 26 downstream of the throttle valve 4.

When the valve 15 in the auxiliary housing 5 is in its raised position, air flows into the housing 5 and then out into the main line 131. The air flows down past the throat 140 through the main line 131 and also flows into the branch line 21. The air reaches the check valves 19 and 23 and forces them open against the force of the springs 20 and 24, respectively. Thus, the air flows through the main line 131 and the branch line 21 back into the main housing 2. Whether the air leaving the auxiliary housing 5 or the greater part thereof flows through the main line 131 into the main housing 2 downstream of the throttle valve 4 or through the branch line 21 into the venturi throat 2*a*, depends upon the relative level of the negative pressure existing in the downstream of the throttle valve 4 or in the venturi throat 2*a*. It will be noted that the check valve 19 in the main line 131 is provided to prevent a portion of the fuel-air mixture from flowing into the venturi throat 2*a* through the branch line 21 when the valve 15 in the auxiliary housing 5 is closed, while the check valve 23 in the branch line 21 is provided to prevent a portion of air from flowing into the downstream of the throttle valve 4 through the main line 131 when the valve 15 is closed.

While the invention has been described with reference to some embodiments thereof, it is to be understood that further variations or modifications may easily be made by those of ordinary skill in the art without departing from the scope of the invention which is defined by the appended claims. For instance, the valve 15 in the auxiliary housing 5 may be provided at the outlet 12*b* of the first air passageway 12 with equally satisfactory results, instead of being provided at the inlet 13*a* or 131*a* of the second air passageway 13 or 130 as described. The valve 15 may be of any other type. In the embodiments hereinabove described, the valve supporting member 16 is of the bimetallic construction and detects variation in the temperature of the air in the auxiliary housing 5, in response to which the valve 15 opens or closes the second air passageway 13 or 130. Such temperature variation may be detected by any other means and the valve 15 may be actuated in response to the temperature variation detected by such detecting means. The diameter of the throat 14 in the second air passageway 13 (or the throat 140 in the second air passageway 130) may vary to obtain an optimum bypass air flow through the auxiliary housing 5. The valve 15 may be adapted to respond to a variable range of predetermined temperatures to establish a bypass flow of air in a most timely manner.

What is claimed is:

1. In an automobile engine carburetor comprising,
a main housing,
a choke valve provided in said main housing,
a venturi throat formed in said main housing and spaced below said choke valve,
a throttle valve provided in said main housing and spaced below said venturi throat,
an auxiliary housing connected to said main housing adjacent to said choke valve,
a coiled bimetallic strip provided in said auxiliary housing and associated with said choke valve to control the position of said choke valve automatically in response to variation in the temperature of the air in said auxiliary housing, and
means provided in said auxiliary housing for electrically heating said bimetallic strip,
the improvement which comprises,
a first air passageway having an inlet open into said main housing upstream of said venturi throat and an outlet open into said auxiliary housing,
a second air passageway having an inlet open into said auxiliary housing and an outlet open into said main housing downstream of said inlet of said first air passageway, the static pressure of said main housing being lower at said outlet of said second air passageway than at said inlet of said first air passageway, and
valve means provided in said auxiliary housing and adapted to close one of said first and second air passageways to stop the flow of fresh air into said auxiliary housing when said temperature is below a predetermined level, while opening said one air passageway upon elevation of said temperature to said predetermined level to resume said flow of fresh air through said auxiliary housing.

2. The invention of claim 1 wherein said inlet of said first air passageway is positioned upstream of said choke valve.

3. The invention of claim 1 wherein said outlet of said second air passageway is positioned downstream of said throttle valve and includes a throat intermediate the ends thereof.

4. The invention of claim 1 wherein said outlet of said second air passageway is open into said venturi throat, and includes a throat intermediate the ends thereof.

5. The invention of claim 1 wherein said valve means comprises:
a supporting member of the bimetallic structure attached at one end to the inner wall of said auxiliary housing, and
a valve member supported on the other end of said supporting member and adapted to close said one air passageway when said temperature is below said predetermined level, said supporting member being deflectable with said elevation of said temperature to move said valve member away from said one air passageway.

6. The invention of claim 5 wherein said valve member is positioned adjacent to said inlet of said second air passageway and adapted to close said second air passageway.

7. The invention of claim 5 wherein said valve member is positioned adjacent to said outlet of said first air passageway and adapted to close said first air passageway.

* * * * *